US005129407A

United States Patent [19]

Phillips

[11] Patent Number: 5,129,407

[45] Date of Patent: Jul. 14, 1992

[54] VARIABLE CAMSHAFT

[75] Inventor: James D. Phillips, Posen, Mich.

[73] Assignee: J. D. Phillips Corporation, Alpena, Mich.

[21] Appl. No.: 712,526

[22] Filed: Jun. 10, 1991

[51] Int. Cl.[5] ..... F16H 25/00

[52] U.S. Cl. ..... 123/90.18; 74/58; 74/567

[58] Field of Search ..... 74/57, 58, 567; 123/90.18, 90.31

[56] References Cited

U.S. PATENT DOCUMENTS

| | | | |
|---|---|---|---|
| 1,556,410 | 10/1925 | Boyer | 123/90.18 |
| 2,528,983 | 11/1950 | Weiss | 123/90.18 X |
| 2,871,837 | 2/1959 | Kerby | 123/90.18 |
| 3,465,602 | 9/1969 | Garaud | 74/58 |
| 3,481,314 | 12/1969 | Crenn | 123/90.18 |
| 4,914,967 | 4/1990 | Prouix et al. | 74/58 X |

FOREIGN PATENT DOCUMENTS

| | | | |
|---|---|---|---|
| 2300827 | 8/1974 | Fed. Rep. of Germany | 123/90.18 |
| 419701 | 1/1911 | France | 123/90.18 |
| WO82/02742 | 8/1982 | PCT Int'l Appl. | 123/90.18 |

*Primary Examiner*—Richard Lorence
*Assistant Examiner*—William O. Trousdell
*Attorney, Agent, or Firm*—Barnes, Kisselle, Raisch, Choate, Whittemore & Hulbert

[57] ABSTRACT

A camshaft is provided having longitudinally spaced cams for operating the valve lifters of an engine. Each cam has juxtaposed first and second cam lobes for operating at low speed conditions (city driving) and high speed conditions (highway). The profile of each cam lobe has a base circle area and the base circle areas of the lobes on each cam are of the same radius and overlap to provide a cross-over zone. While the engine is running and the camshaft is rotating, the camshaft can be shifted longitudinally between a first position in which the valve lifters contact the profiles of the first cam lobes of the cams and a second position in which the valve lifters contact the profiles of the second cam-lobes. The positions of the valve lifters longitudinally of the camshaft in relation to the angular positions of the cross-over zones of the cams is such that during the simultaneous rotation and longitudinal shifting of the camshaft the valve lifters will traverse the cams from the profile of one cam lobe to the other at the cross-over zone.

14 Claims, 3 Drawing Sheets

VARIABLE CAMSHAFT

This invention relates generally to an engine camshaft and refers more particularly to a camshaft capable of changing the lift and timing of the valve train in an engine while the engine is running.

BACKGROUND AND SUMMARY

At present, changing the lift and timing of the valve train of an engine is time-consuming and expensive, requiring the services of a skilled mechanic or technician.

As with conventional camshafts, the camshaft of this invention has cams for operating the valve lifters for the intake and exhaust valves of the engine. However, in accordance with this invention, each cam has more than one lobe. Each cam could very well have more than two lobes, but the invention can just as well be described and illustrated where only two lobes per cam are employed. Only two lobes per cam are needed in the embodiment disclosed hereinafter, which is a camshaft capable of changing the lift and timing of the engine from a position suited for relatively low speed (city street) operation to a position suited for relatively high speed (highway) operation.

In the specific embodiment described hereinafter, the camshaft can be moved longitudinally between a position in which one lobe of each cam is in contact with a valve lifter and another position in which the other lobe contacts the valve lifter. The longitudinal shifting of the camshaft takes place while the camshaft is rotating and the engine is running. Each cam lobe has a base circle area and a nose and ramp area. The base circle areas of the two lobes on each cam are the same radius. For a given cam, the shift from one lobe to the other cannot take place when the valve lifter is on the nose or ramp area of one of the lobes because of the step involved. Shifting, therefore, takes place at the base circle area. This is accomplished by providing an overlap in the base circle areas of the two lobes of each cam, by proper spacing of the cams along the length of the camshaft, by proper lateral positioning of the valve lifters relative to the cams, and by careful timing of the camshaft shift.

It is an object of this invention to provide a variable camshaft having the attributes referred to above, which will improve engine economy, performance, reduce emissions over a wide range of driving conditions, and which is of relatively simple design and construction having only a few moving parts, and is rugged and dependable in operation.

Other objects, features and advantages of the invention will become more apparent as the following description proceeds, especially when considered with the accompanying drawings.

DETAILED DESCRIPTION

Figure 1:
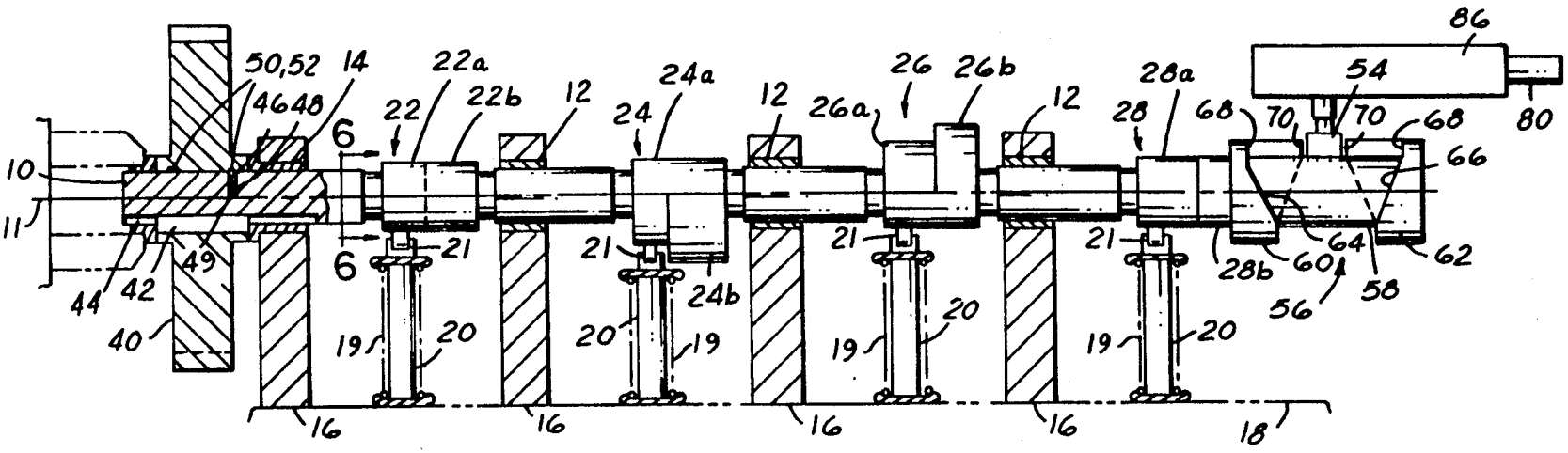
FIG. 1 is a semi-diagrammatic side elevational view of a camshaft constructed in accordance with the invention, in which the camshaft is shown located at one of its limiting positions.

Referring now more particularly to the drawings, there is shown an elongated camshaft 10 supported for rotation about its longitudinal central axis or centerline 11 and also for longitudinal movement in bearings 12 and thrust bearings 14 carried by bearing supports 16.

The camshaft is mounted adjacent to the cylinder head 18 of an internal combustion engine and has intake and exhaust valves 20 provided with valve lifters 21. The camshaft has cams 22, 24, 26 and 28 at spaced points along its length with one cam opposite each of the valve lifters 21. The valve lifters 21 are preferably in the form of rollers. Compression coil springs 19 surround the valves 20 and maintain the lifters 21 in contact with the cams.

Each cam has cam lobes which are juxtaposed, that is in side-by-side relation, longitudinally of the camshaft. Thus cam 22 has cam lobes **22*a* and 22*b*, cam 24 has cam lobes 24*a* and 24*b*, cam 26 has cam lobes 26*a* and 26*b*, and cam 28 has cam lobes 28*a* and 28*b***.

Figure 6:
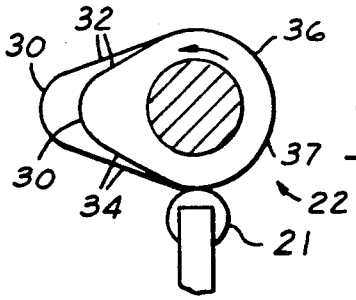
FIG. 6 is a sectional view on the line 6—6 in FIG. 1 showing one of the cams.

As seen in FIG. 6, the profile of each cam lobe of cam 22 includes a nose 30 and ramps 32 and 34 which lead to the nose from opposite ends of the base circle area 36. The base circle area of each cam lobe is approximately 180° in arcuate extent and the base circle areas of the lobes have the same radius and circumferentially overlap so that there is a crossover or transition zone 37 at the overlap. As seen in FIG. 6, the cross-over zone or overlap is preferably approximately 180° in extent. The other cams 24–28 and their lobes are similarly formed. However, cams 22–28 are located at different angular positions around the axis of the camshaft.

The camshaft is rotated by a drive gear 40 keyed to the camshaft by an elongated longitudinally extending key 42 secured to the central opening in the drive gear and supported for longitudinal sliding movement in the elongated, longitudinally extending slot 44 in one end of the camshaft.

Figure 3:
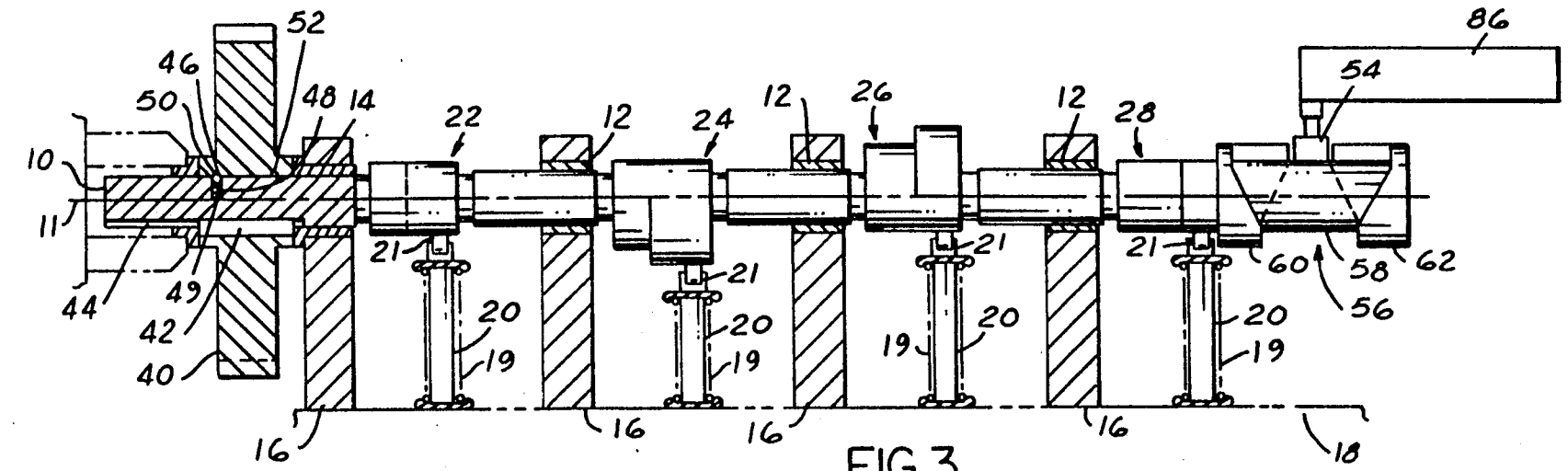
FIG. 3 is a view similar to FIGS. 1 and 2, but shows the camshaft at its other limiting position.

The camshaft is capable of longitudinal movement from the FIG. 1 position to the FIG. 3 position. A spring-loaded detent 46 in a radial passage 48 in the camshaft is urged by a spring 49 radially outwardly into engagement with the drive gear 40. Longitudinally spaced grooves 50 and 52 in the drive gear are adapted to be engaged by the detent 46 to releasably retain the camshaft in either the FIG. 1 or the FIG. 3 position. The nose of the detent 46 is tapered to fit the tapered groove contour. The detent will be cammed out of the groove in which it is seated when the camshaft is shifted, as more clearly explained hereinafter.

While the engine is running and the camshaft 10 is rotating, the camshaft is moved longitudinally by a driver 54 operating in conjunction with the camming mechanism 56 at the opposite end of the camshaft. The camming mechanism 56 comprises a central cylindrical portion 58 of the camshaft, with radially outwardly projecting and circumferentially extending cams 60 and 62, respectively, at the ends of the cylindrical portion 58. The cams extend throughout substantially 360° and their inner edge portions define cam tracks 64 and 66 which extend from a low point 68 to a high point 70. Between the low and high points, the cam tracks are generally helical. The driver 54 and cam tracks 64 and 66 are capable during rotation of the camshaft, of moving the camshaft between the positions of FIGS. 1 and 3 where it is releasably retained by the detent 46.

The driver 54 is in the form of a roller engageable with the cam tracks 64 and 66. Roller 54 may be moved lengthwise of the camshaft by a piston-cylinder assembly 74 having a piston 76 reciprocable within a cylinder 78. A piston rod 80 extends from the piston 76 and the roller 54 is mounted on the outer end of the piston rod. The operation of the piston-cylinder assembly 74 to shift the camshaft may, for example, be automatic with computer control or manual at the will of the driver. A simple manual system will now be described.

Figure 4:
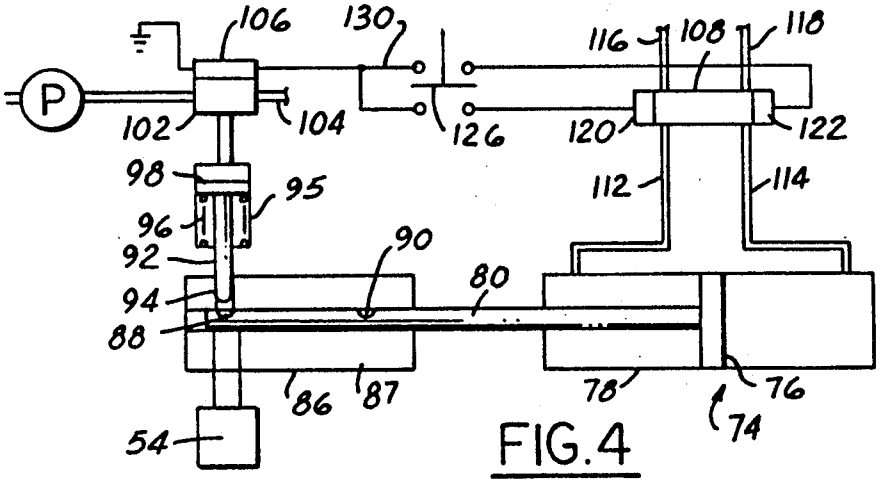
FIG. 4 is a diagrammatic view showing a mechanism for shifting the camshaft.

Referring to FIG. 4, piston rod 80 has spaced notches 88 and 90 and moves in a passage 84 in block 86. A longitudinal slot 87 in block 86 clears the connection 89 between rod 80 and roller 54. A locking pin 92 slidable in a transverse bore 94 in block 86 is adapted to engage in the notches. The pin 92 moves in a cylinder 95 and is normally retracted away from the piston rod by a spring 96 bearing against the head 98 of the pin. The pin may be advanced against the force of spring 96 to engage one of the notches by fluid pressure at the head end of cylinder 95 delivered by fluid passage 100 from a pressure source P through a valve 102. The valve 102 normally vents the head end of the cylinder through passage 104 but connects the head of the cylinder to the pressure source P when operated by the time-delay relay 106.

A valve 108 controls the flow of fluid to and from the ends of cylinder 78 through fluid passages 112 and 114. A passage 116 from a pressure source leads to the valve 108 and vent passage 118 leads away from the valve. The valve has three positions—in one position it delivers fluid pressure to the rod end of the cylinder and vents the head end; in a second position it delivers pressure fluid to the head end of the cylinder and vents the rod end; and in a third position it vents both ends of the cylinder. In the normal position of the valve it vents both ends. The valve is shifted to a position delivering pressure fluid to one end or the other of the cylinder by the relays 120 and 122.

Figure 2:
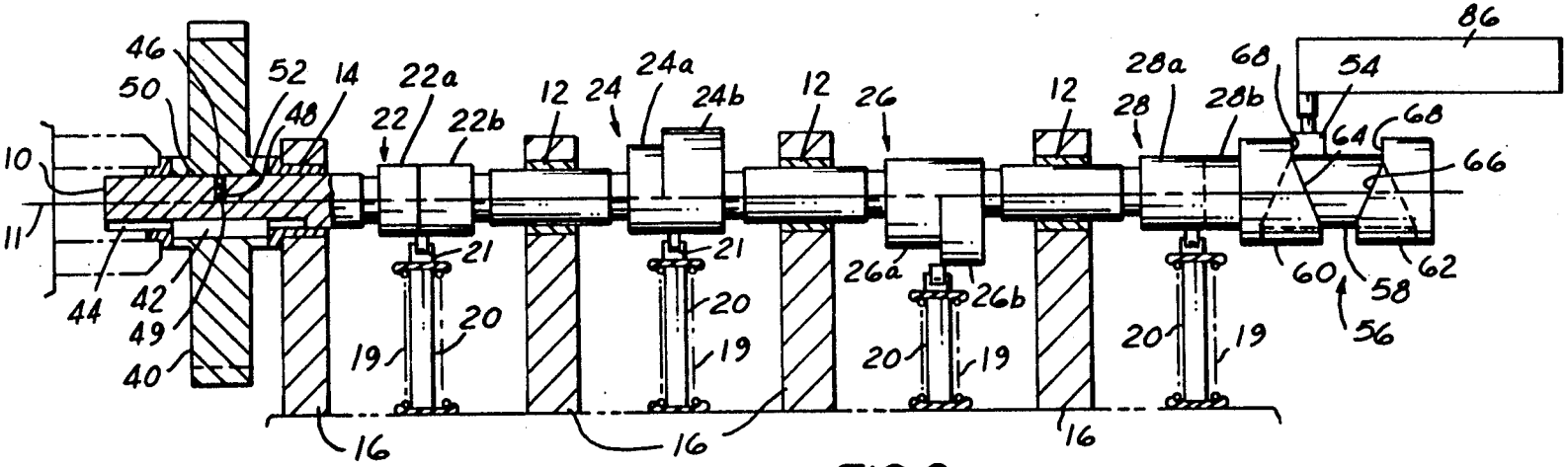
FIG. 2 is a view similar to FIG. 1, but shows the camshaft in an intermediate position.

The relays 120 and 122 and the time-delay relay 106 may be operated by a simple electric circuit 130 having a manual control contact 126. When this control contact 126 is shifted to the upper position closing the circuit 130 to relay 122 and time-delay 106, the valve 78 is shifted to a position delivering pressure fluid to the head end of the cylinder 78 and venting the rod end, causing the piston rod to move left in FIG. 1 -3. The piston rod is urged left with a yielding pressure so that the roller 54 can follow the contour of cam track 64 up to the high point 70 after which the roller 54 will snap to the low point 68 of the cam track. The time-delay relay 106, after a short time interval, activates the valve 102 to advance pin 92 and engage notch 90 to lock the roller 54 in position. Subsequent rotation of the camshaft, with the roller 54 engaging the cam track and with the roller locked in position, will cause the camshaft to shift left, in the process causing the detent 46 to be cammed out of the groove 52 in the drive gear. FIG. 2 shows the camshaft in an intermediate position half way through the shift and FIG. 3 shows the camshaft fully shifted in which the detent 46 has snapped into the other groove 50 in the drive gear. The complete shift of the camshaft from the FIG. 1 position to the FIG. 3 position may take place in only one or two revolutions of the camshaft, in less than a second. The camshaft may, for example, be rotating at 150 R.P.M. When the control contact 126 is released, it returns to the neutral position de-energizing the relay 122 and the time-delay relay 106. The valve 102 vents cylinder 95 allowing the pin 92 to retract by the pressure of spring 96 and withdraw from the notch in the piston rod 80. The valve 108 returns to its normal position venting both ends of cylinder 78.

Figure 5:
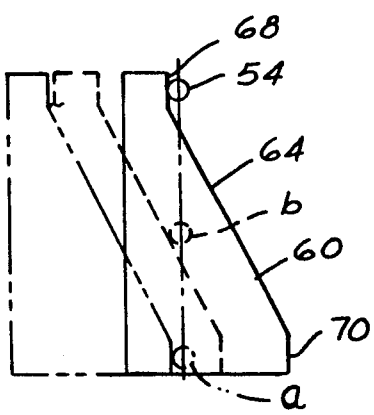
FIG. 5 is a development of a cam track on the camshaft, shown in three positions.

FIG. 5 shows a development of the cam 60 of camming mechanism 56 on the camshaft, in three positions. As noted, at the beginning of the leftward shift the roller 54 is in the position at the top of the Figure, engaging the low point 68 of the cam track 64. At the end of the leftward shift of the camshaft, the roller, shown at position a, engages the cam track at the high point 70. At the midpoint in the shift, the roller, shown at position b, engages the helical portion of the cam shaft.

The camshaft may be shifted back to the FIG. 1 position by manually moving the control contact 126 to the lower position closing the circuit 130 to relay 120 and time-delay relay 106, this time delivering pressure fluid to the rod end of cylinder 78 while venting the head end and causing the piston rod 80 to move right in FIGS. 1-3. The roller 54 will be locked in position by the pin 92 engaging notch 88, the roller 54 will engage cam track 66 and the camshaft will shift to the right, back to the FIG. 1 position where detent 46 will snap into groove 52.

Thus it will be seen that the longitudinal shift of the camshaft from one position to the other takes place while the camshaft is rotating through a predetermined arc and in timed relation to the rotation of the camshaft and while the engine is running.

As previously stated, each of the cams 22, 24, 26, and 28 has two cam lobes and there is a cross-over 37 zone at the overlap between the base circle areas thereof. When the valve lifter for a particular cam transfers from contact with one cam lobe to the other, the transfer must occur at the cross-over zone, because at the cross-over zone the cam lobes are of equal radius. At any other point, there would be a step from one cam lobe to the other because of the difference in radius. Therefore, the positions of the valve lifters lengthwise of the camshaft in relation to the angular positions of the cross-over zones must be such that during the simultaneous rotation and longitudinal shifting of the camshaft the valve lifters will traverse the cams from the profile of one cam lobe to the other at the cross-over zones.

Figure 7:
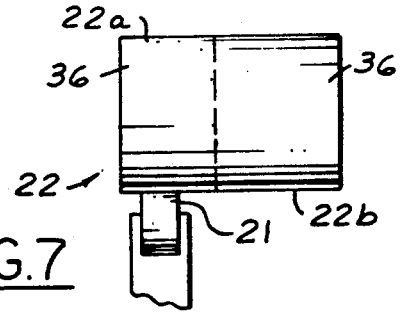
FIG. 7 is a view of the cam of FIG. 6 as seen from the right.
Figure 8:
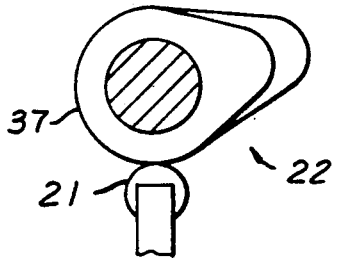
FIGS. 8–13 are similar to FIGS. 6 and 7 but show the cam in different positions.
Figure 9:
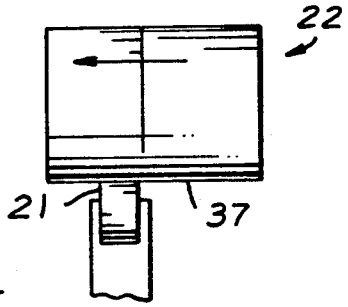
Figure 10:
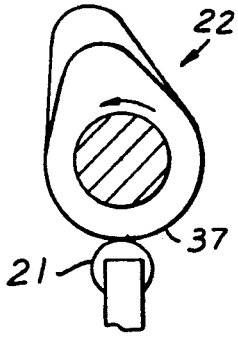
Figure 11:
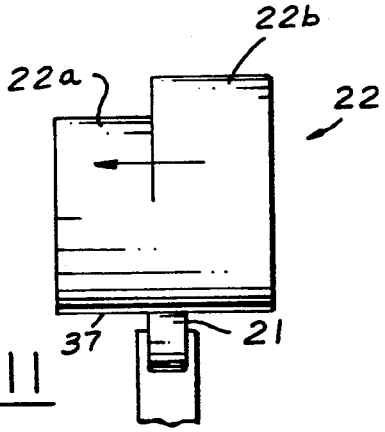
Figure 12:
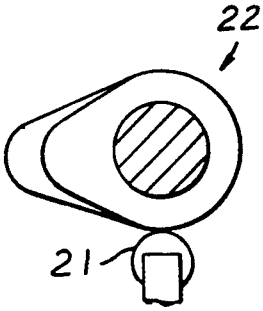
Figure 13:
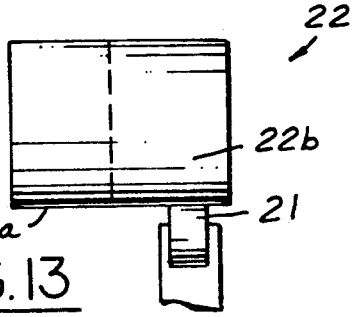

In the present instance, the cross-over zones of the cams 22-28 are located at different points around the circumference of the camshaft. Accordingly, for each cam the cross-over from one lobe to the other will occur at a different point in the rotation of the camshaft. Referring to FIGS. 6 -13 there is illustrated the cam 22 at four different angular positions. FIGS. 6 and 7 show the 0° position of the cam with the valve lifter 21 contacting lobe 22*a*. FIGS. 8 and 9 show the 195° position of the cam with the valve lifter 21 contacting the base circle areas at one end of the cross-over or transition zone 37. FIGS. 10 and 11 show the 285° position with the valve lifter 21 at the other end of the transition zone. FIGS. 12 and 13 show the 360° position with the valve lifter 21 in contact with the lobe 22*b*. The transition from one lobe to the other for the other cams 24-28 is accomplished in the same manner, but at different angular positions in the rotation of the camshaft.

What is claimed is:

1. In an engine having a cylinder head provided with valves for controlling the flow of motive fluid in the engine and an elongated camshaft having cams spaced apart longitudinally of said camshaft for operating said valves, the improvement wherein each said cam has longitudinally juxtaposed first and second cam lobes, each cam lobe having an annular profile extending circumferentially of said camshaft, the profile of each cam lobe having a base circle area of limited arcuate extent, the base circle areas of the profiles of the juxtaposed lobes of each cam being of the same radius and overlapping circumferentially to provide a cross-over zone, said valves having valve lifters respectively opposed to said cams, said camshaft being supported for longitudinal movement between a first position in which said valve lifters contact the profiles of said first cam lobes and a second position in which said valve lifters contact the profiles of said second cam lobes, means for rotating said camshaft to cause said cams to operate said valves, and means for longitudinally shifting said camshaft from said first position to said second position and vice versa while said camshaft is rotating through a predetermined arc and in timed relation to the rotation of said camshaft through said predetermined arc, the positions of said valve lifters longitudinally of said camshaft in relation to the angular position of said cross-over zones being such that during the simultaneous rotation and longitudinal shifting of said camshaft said valve lifters will traverse said cams from the profile of one juxtaposed cam lobe to the profile of the other at said cross-over zones, said means for longitudinally shifting said camshaft including a circumferentially extending generally helical cam track on said camshaft, a driver, and means for moving said driver from a first position to a second position engaging said cam track so that subsequent rotation of said camshaft while said driver is in engagement with said cam track will cause longitudinal shifting of said camshaft.

2. Structure as defined in claim 1, wherein said simultaneous rotation and longitudinal shifting of said camshaft occurs while the engine is running.

3. Structure as defined in claim 1, including means for releasably locking said camshaft in said first and second positions.

4. In an engine having a cylinder head provided with valves for controlling the flow of motive fluid in the engine and an elongated camshaft having cams spaced apart longitudinally of said camshaft for operating said valves, the improvement wherein each said cam has longitudinally juxtaposed first and second cam lobes, each cam lobe having an annular profile extending circumferentially of said camshaft, the profile of each cam lobe having a base circle area of limited arcuate extent, the base circle areas of the profiles of the juxtaposed lobes of each cam being of the same radius and overlapping circumferentially to provide a cross-over zone, said valves having valve lifters respectively opposed to said cams, said camshaft being supported for longitudinal movement between a first position in which said valve lifters contact the profiles of said first cam lobes and a second position in which said valve lifters contact the profiles of said second cam lobes, means for rotating said camshaft to cause said cams to operate said valves, and means for longitudinally shifting said camshaft from said first position to said second position and vice versa while said camshaft is rotating through a predetermined arc and in timed relation to the rotation of said camshaft through said predetermined arc, the positions of said valve lifters longitudinally of said camshaft in relation to the angular position of said cross-over zones being such that during the simultaneous rotation and longitudinal shifting of said camshaft said valve lifters will traverse said cams from the profile of one juxtaposed cam lobe to the profile of the other at said cross-over zones, said means for longitudinally shifting said camshaft including first and second longitudinally spaced, circumferentially extending cam tracks on said camshaft, a driver, and means for moving said driver selectively to a first position or a second position for engagement with either said first or said second cam track so that subsequent rotation of said camshaft will cause longitudinal shifting of said camshaft in one direction or the other depending on which cam track is engaged by said driver.

5. Structure as defined in claim 4, wherein said cam tracks are generally helical.

6. Structure as defined in claim 5, including means for releasably locking said camshaft in said first and second positions.

7. Structure as defined in claim 6, wherein said releasable locking means includes a detent.

8. Structure as defined in claim 6, including means for releasably locking said driver in said first and second positions thereof during the longitudinal shifting of said camshaft.

9. Structure as defined in claim 8, including means for unlocking said driver after longitudinal shifting of said camshaft.

10. Structure as defined in claim 9, wherein said simultaneous rotation and longitudinal shifting of said camshaft occurs while the engine is running.

11. In an engine having a cylinder head provided with valves for controlling the flow of motive fluid in the engine and an elongated camshaft having cams spaced apart longitudinally of said camshaft for operating said valves, the improvement wherein each said cam has longitudinally juxtaposed first and second cam lobes, each cam lobe having an annular profile extending circumferentially of said camshaft, said valves having valve lifters respectively opposed to said cams, said camshaft being supported for longitudinal movement between a first position in which said valve lifters contact the profiles of said first cam lobes and a second position in which said valve lifters contact the profiles of said second cam lobes, means for rotating said camshaft while the engine is running to cause said cams to operate said valves, and means for longitudinally shifting said camshaft from said first position to said second position and vice versa, while said camshaft is rotating and in timed relation to such rotation of said camshaft, said means for longitudinally shifting said camshaft including a circumferentially extending, generally helical cam track on said camshaft, a driver, and means for moving the driver to a first position engaging said cam track so that subsequent rotation of said camshaft while said driver is in engagement with said cam track will cause longitudinal shifting of said camshaft to one of the first and second positions thereof.

12. Structures as defined in claim 11, wherein said means for longitudinally shifting said camshaft includes a second circumferentially extending, generally helical cam track on said camshaft spaced axially from the first-mentioned cam track, and means for moving said driver to a second position engaging said second cam track so that subsequent rotation of said camshaft while said driver is in engagement with said second cam track will cause longitudinal movement of said camshaft to the other of the first and second positions thereof.

13. Structure as defined in claim 12, and further including means for releasably locking said camshaft in its first and second positions.

14. Structure as defined in claim 12, and further including means for releasably locking said driver in its first and second positions during the longitudinal shifting of said camshaft.

* * * * *